US006752146B1

(12) United States Patent
Altshuler et al.

(10) Patent No.: US 6,752,146 B1
(45) Date of Patent: Jun. 22, 2004

(54) CIVILIAN ANTI-TERRORIST ATTACK GAS MASK

(76) Inventors: Boris Altshuler, 4812 14th Ave. Apt. 6-H, Brooklyn, NY (US) 11219; James F. Reynolds, 36 Plymouth Rd., Summit, NJ (US) 07901

( * ) Notice: Subject to any disclaimer, the term of this patent is extended or adjusted under 35 U.S.C. 154(b) by 0 days.

(21) Appl. No.: 10/314,547

(22) Filed: Dec. 9, 2002

Related U.S. Application Data

(60) Provisional application No. 60/339,839, filed on Dec. 10, 2001.

(51) Int. Cl.[7] ..... A62B 19/00

(52) U.S. Cl. ..... 128/201.25; 128/205.12; 128/205.27; 128/204.18; 2/171.3; 2/209.12; 2/175.1; 2/195.1

(58) Field of Search ..... 128/200.14, 200.24, 128/201.22–202.11, 203.29, 204.18, 205.12, 205.25, 205.26, 205.77–207.18; 2/410, 5, 6.1–6.7, 417–421, 425, 9, 468, 171, 171.2, 171.3, 202–206, 209.12, 175.1, 195.1–195.7

(56) References Cited

U.S. PATENT DOCUMENTS

| | | | | | |
|---|---|---|---|---|---|
| 4,549,542 | A | * | 10/1985 | Chien | 128/201.24 |
| 4,852,562 | A | * | 8/1989 | Howie | 128/201.25 |
| 4,893,356 | A | * | 1/1990 | Waters | 2/171.3 |
| 5,425,620 | A | * | 6/1995 | Stroud | 416/63 |
| 5,577,495 | A | * | 11/1996 | Murphy | 128/201.24 |
| 5,847,651 | A | * | 12/1998 | Lu | 340/573.1 |
| 6,622,311 | B2 | * | 9/2003 | Diaz et al. | 2/171.3 |

* cited by examiner

*Primary Examiner*—Glenn K. Dawson
(74) *Attorney, Agent, or Firm*—Arthur Jacob

(57) ABSTRACT

A civilian anti-terrorist attack gas mask used as an emergency measure to remove hazardous air pollutants present in air drawn from an ambient atmosphere to provide a person with suitably breathable air is provided in the form of a cap fitted over the person's head and carrying a hood draped over the person's head to establish a chamber contiguous with the person's face, the gas mask including an impeller assembly placed in a peak on the cap for drawing air from the ambient atmosphere through an adsorption element and a filter element to circulate fresh breathable air through the chamber, the impeller assembly maintaining an air pressure in the chamber raised above the ambient air pressure.

16 Claims, 1 Drawing Sheet

CIVILIAN ANTI-TERRORIST ATTACK GAS MASK

Figure 1:
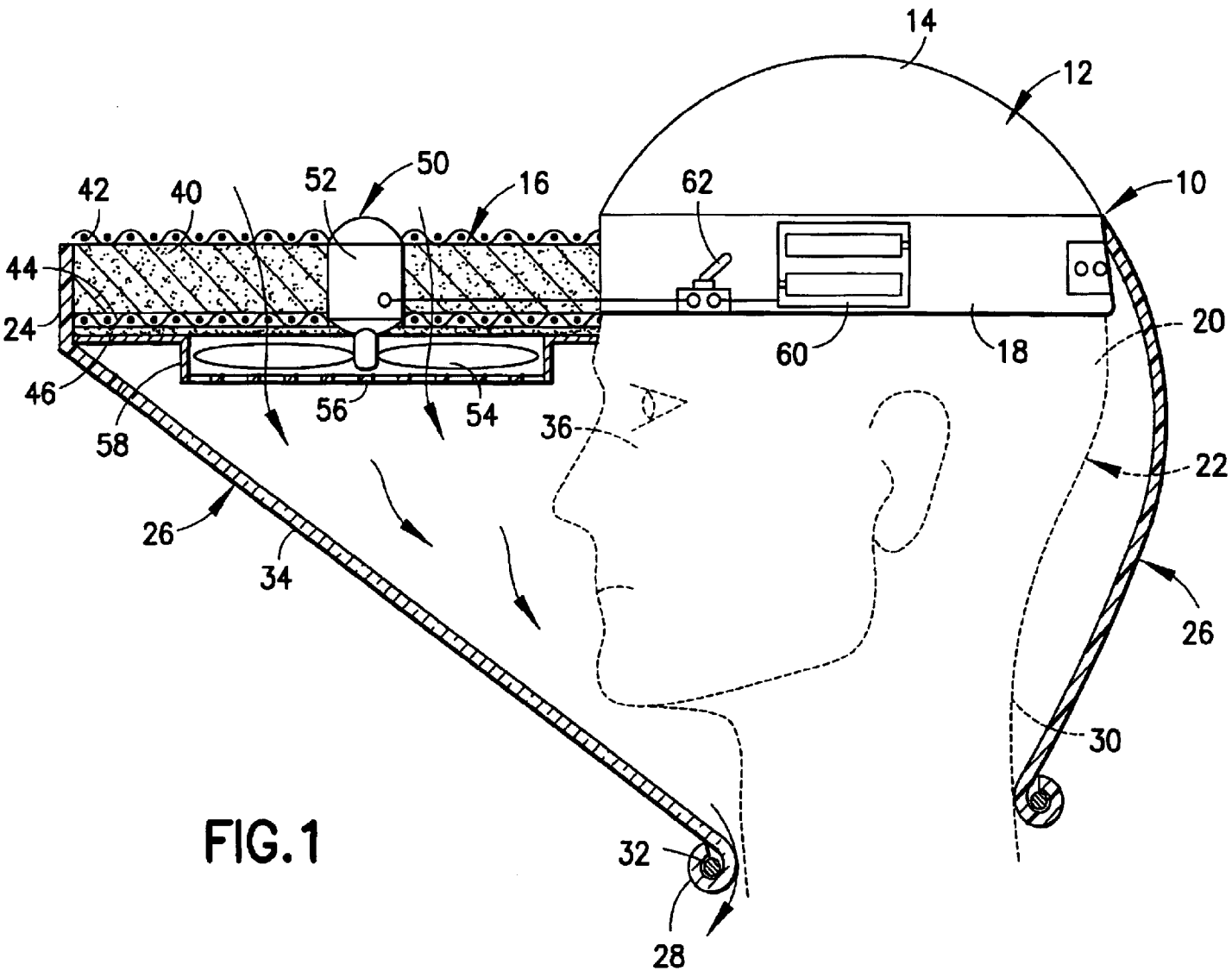

This application claims the benefit of provisional application Serial No. 60/339,839, filed Dec. 10, 2001.

The present invention relates generally to anti-terrorist attack measures available to civilians and pertains, more specifically, to a gas mask available to civilians as an emergency measure to counter biological, germ and gas contaminants in the air.

Recent events have prompted the need for the emergency protection of civilians from biological, germ and poisonous gas pollutants in the air, generally designated herein as hazardous air pollutants (HAPs). The most effective methods for controlling HAPs utilize adsorption to remove HAPs from the ambient air. The most common adsorbent employed in such methods is activated carbon. Activated particles in a bed of activated carbon are very porous and have large surface-to-volume ratios. Gases penetrate pore spaces in the bed and contact the large surface areas provided in the bed, where the HAPs adhere so as to be eliminated from the ambient air.

The HAP is held on the activated carbon surface either by physical attractive forces or, in certain cases, depending upon the chemical nature of the molecule and the surface, by chemical forces (chemisorption). In any particular system, both types of adsorption can occur, as well as some intermediate types of adsorption. The adsorption capacity of activated carbon for any given HAP may be represented by an adsorption isotherm that relates the amount of HAP adsorbed (adsorbate) to the equilibrium pressure (concentration) at a constant temperature. Typically the adsorption capacity of activated carbon increases as molecular weight of the HAP increases. Unsaturated compounds are more completely adsorbed than saturated compounds, and cyclical compounds are more easily adsorbed than linearly structured materials.

Adsorption is not unlimited. As the exposed surfaces become increasingly covered with molecules of adsorbate, the rate of adsorption diminishes, reaching zero when saturation of the surface is complete. Thus, the useful life of an activated carbon bed depends upon the concentration of HAP in the air, the amount of gas which passes through the carbon bed, and the total amount of carbon in the bed. A good grade of activated carbon in a bed reaches saturation under high concentrations of HAP when the amount of HAP adsorbed reaches about twenty percent of the weight of carbon in the bed. Lesser grades adsorb down to about five to eight percent of the weight of carbon in the bed.

Adsorption in an activated carbon bed also effectively removes very low concentrations of organics and such beds frequently are specified for air deodorization where the concentration of pollutants often is below five parts-per-million (ppm). Bed depth in such current commercial carbon bed cleaners utilizing granular activated carbon generally is in the range of about 0.5 inch to 3.0 inches, with nominal bed residence times of about 0.025 second to 0.1 second. Carbon systems which are combined with air conditioning filters have a suitable design value of air flow rate of 0.1 ft/second for a bed depth of 0.5 inch.

The properties of different activated carbons can vary widely, and all activated carbons are selective to a certain degree. Activated carbon can be utilized in the form of particles or granules, as well as in the form of activated carbon fibers and carbon-coated fibers. Activated carbon remains as the only reliable physical adsorbing agent for protection against anticipated poison gas attacks.

Accordingly, activated carbon is one of the ingredients of civilian and military gas masks and is installed in air conditioning equipment used in connection with underground shelters.

The present invention utilizes the above attributes of activated carbon in a civilian gas mask which can protect personnel against chemical and biological terrorist attacks. As a rule, such attacks take place under indoor conditions, within buildings, shopping malls, subways and the like, where the highest concentration of chemical and biological agents can serve as weapons utilizing a minimum amount of toxic compounds. In such situations, a civilian gas mask need be used for only the relatively short period of time during which personnel can be evacuated to a safe environment. Typically, that duration will be less than one hour.

The present invention provides several objects and advantages, some of which are summarized as follows: Provides a small and compact gas mask which can be stored conveniently in a drawer, or readily carried in a briefcase or coat pocket for emergency use; is available for ready use during a period sufficient to allow a user to escape a contaminated area; is simple in construction and effective in combating biological, germ and poisonous gas contamination; allows full visual effectiveness with enough roominess to avoid claustrophobic reactions, as well as other stressful and emotional effects; enables continuous circulation of fresh, breathable air for promoting well-being; precludes condensation and concomitant impairment of vision by supplying continuously circulated fresh air; provides a simplified construction which is economical to manufacture and easy to use; adapts a universally accepted cap construction for effective and reliable performance readily made available for widespread use.

The above objects and advantages, as well as further objects and advantages, are attained by the present invention which may be described briefly as a civilian anti-terrorist attack gas mask for use by a person as an emergency measure to remove hazardous air pollutants present in air drawn from an ambient atmosphere having an ambient air pressure, and provide the person with suitably breathable air, the gas mask being configured for fitting over the person's head, above the person's neck and adjacent the person's face, the gas mask comprising: a support structure configured for fitting to the person's head; a brim carried by the support structure for projecting outwardly from the person's head upon fitting the support structure to the person's head, the brim having an outside and an inside; a hood carried by the brim and extending from the brim for establishing a chamber having at least a portion contiguous with the person's face, the chamber being bounded by the hood and the inside of the brim; a passage in the brim, the passage extending from the inside of the brim to the outside of the brim so as to communicate with the chamber and with the ambient atmosphere; an adsorption element in the passage for communicating with the chamber and with the ambient atmosphere; and an impeller assembly for drawing air from the ambient atmosphere into the passage and passing the air through the adsorption element and into the chamber to remove hazardous air pollutants from the air drawn into the passage and deliver an essentially continuous supply of fresh breathable air to the chamber while maintaining an air pressure in the chamber raised above the ambient air pressure.

The invention will be understood more fully, while still further objects and advantages will become apparent, in the following detailed description of a preferred embodiment of the invention illustrated in the accompanying drawing, in which the single FIGURE is a longitudinal cross-sectional view showing a civilian gas mask constructed in accordance with the present invention.

Referring now to the single FIGURE of the drawing, a civilian gas mask constructed in accordance with the present invention is illustrated at 10 and is seen to include a support structure having an overall configuration resembling a common baseball cap 12 including a crown 14 and a brim in the form of a peak 16. The crown 14 incorporates an adjustable flexible band 18 which enables the crown 14 to be fitted appropriately to the head 20 of a person 22, as shown.

Peak 16 extends forward from the crown 14 to a forward end 24, and a hood 26 is carried by the cap 12 and depends from the cap 12 to drape downwardly over the head 20 of the person 22, as shown. Hood 26 is constructed of a pliable material and extends downwardly to a lowermost terminal end 28 where the hood 26 is gathered around the neck 30 of the person 22, as by a gathering arrangement which includes a drawstring 32, for fitting loosely about neck 30 for purposes described below. At least a forward portion 34 of the hood 26 is transparent and falls in front of the face 36 of the person 22 to provide a transparent window through which the person 22 can view surroundings. To that end, hood 26 preferably is constructed of a synthetic polymeric material, such as PVC, which provides the hood 26 with a requisite pliability and flexibility as well as the desired transparency at portion 34.

Peak 16 includes an activated carbon adsorption element 40 placed within a passage 41 extending between an upper support screen 42, located at the outside of the peak 16, and a lower support screen 44, located at the inside of the peak 16. A fine particle filter element 46 is placed within the passage 41, beneath the carbon element 40. Carbon element 40 may be in the form of a bed of carbon particles or granules, or activated carbon fibers or carbon-coated fibers. An impeller assembly in the form of a fan 50 includes a motor 52 secured at peak 16 and an impeller 54 housed within a safety cage 56 which includes a tubular shroud 58 depending from the inside of the peak 16 and extending circumferentially around impeller 54. A power supply shown in the form of a battery pack 60 is secured to the cap 12 at the band 18 and is connected selectively to the fan 50 through a power switch 62.

With the cap 12 in place on the person 22, as shown, the switch 62 is operated to actuate the fan 50. Ambient air is drawn through the passage 41 and into the hood 26 through the activated carbon adsorption element 40 and the filter element 46 so that any toxic compounds in the ambient air are adsorbed, any fine particulate materials, including biological agents, are filtered from the air, and the air supplied to the person 22 is suitable for breathing, free of toxic compounds and other harmful particulate materials. At the same time air pressure within the hood 26 is raised above ambient air pressure so as to preclude the leakage of contaminated ambient air into the hood 26, especially at the loosely fitted terminal end 28. An essentially continuous supply of fresh breathable air is assured by the continued operation of fan 50, with the exhaust of air from beneath the hood 26 taking place largely at the loosely fitting terminal end 28 of the hood 26. Unwanted condensation of water on the transparent portion 34 is prevented by the continuous circulation of fresh air within the hood 26. In addition, the continuous circulation of fresh air, as accomplished by the fan 50, enables easy breathing, especially for older people and people with breathing problems and, combined with the roominess provided under hood 26, promotes a certain amount of well-being in that any claustrophobic effects are reduced, with a concomitant reduction of stress and nervous emotional effects. Further, the roominess provided under the hood 26 enables effective use of the gas mask 10 by persons having facial hair and persons wearing glasses.

It will be seen that the present invention attains the several objects and advantages summarized above, namely: Provides a small and compact gas mask which can be stored conveniently in a drawer, or readily carried in a briefcase or coat pocket for emergency use; is available for ready use during a period sufficient to allow a user to escape a contaminated area; is simple in construction and effective in combating biological, germ and poisonous gas contamination; allows full visual effectiveness with enough roominess to avoid claustrophobic reactions, as well as other stressful and emotional effects; enables continuous circulation of fresh, breathable air for promoting well-being; precludes condensation and concomitant impairment of vision by supplying continuously circulated fresh air; provides a simplified construction which is economical to manufacture and easy to use; adapts a universally accepted cap construction for effective and reliable performance readily made available for widespread use.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A civilian anti-terrorist attack gas mask for use by a person as an emergency measure to remove hazardous air pollutants present in air drawn from an ambient atmosphere having an ambient air pressure, and provide the person with suitably breathable air, the gas mask being configured for fitting over the person's head, above the person's neck and adjacent the person's face, the gas mask comprising:

a support structure configured for fitting to the person's head;

a brim carried by the support structure for projecting outwardly from the person's head upon fitting the support structure to the person's head, the brim having an outside and an inside;

a hood carried by the brim and extending from the brim for establishing a chamber having at least a portion contiguous with the person's face, the chamber being bounded by the hood and the inside of the brim;

a passage in the brim, the passage extending from the inside of the brim to the outside of the brim so as to communicate with the chamber and with the ambient atmosphere;

an adsorption element in the passage for communicating with the chamber and with the ambient atmosphere; and an impeller assembly for drawing air from the ambient atmosphere into the passage and passing the air through the adsorption element and into the chamber to remove hazardous air pollutants from the air drawn into the passage and deliver an essentially continuous supply of fresh breathable air to the chamber while maintaining an air pressure in the chamber raised above the ambient air pressure.

2. The gas mask of claim 1 including a filter element in the passage, between the adsorption element and the impeller assembly, for filtering particles from air passing through the passage into the chamber.

3. The gas mask of claim 2 wherein the adsorption element comprises activated carbon.

4. The gas mask of claim 1 wherein the support structure comprises a cap for fitting over the person's head, the brim comprises a peak projecting outwardly in a forward direction from the cap, and the portion of the chamber is located immediately forward of the person's face upon fitting the cap over the person's head.

5. The gas mask of claim 4 wherein the hood depends from the peak and includes a lowermost terminal end for fitting loosely about the neck of the person such that the loosely fitting terminal end enables exhaust of air from the chamber to the ambient atmosphere at the terminal end for facilitating the circulation of fresh air through the chamber.

6. The gas mask of claim 5 wherein the hood is constructed of a pliable material and includes a gathering arrangement for gathering the hood around the person's neck adjacent the terminal end of the hood.

7. The gas mask of claim 6 wherein the hood includes a transparent window portion for placement in front of the person's face.

8. The gas mask of claim 7 wherein the gathering arrangement includes a drawstring.

9. The gas mask of claim 1 wherein the impeller assembly includes an impeller and a drive motor, and a power supply is carried by the support assembly for selective connection to the drive motor to actuate the impeller for drawing air from the ambient atmosphere into the passage.

10. The gas mask of claim 9 including a cage carried by the brim and extending around the impeller.

11. The gas mask of claim 10 wherein the cage includes a tubular shroud extending circumferentially around the impeller.

12. The gas mask of claim 11 wherein the cage is located beneath the adsorption element and depends from the inside of the brim.

13. The gas mask of claim 12 including a filter element in the passage, between the adsorption element and the impeller, for filtering particles from air passing through the passage into the chamber.

14. The gas mask of claim 13 wherein the adsorption element comprises activated carbon.

15. The gas mask of claim 14 wherein the support structure comprises a cap for fitting over the person's head, the brim comprises a peak projecting outwardly in a forward direction from the cap, and the portion of the chamber is located immediately forward of the person's face upon fitting the cap over the person's head.

16. The gas mask of claim 15 wherein the hood depends from the peak and includes a lowermost terminal end for fitting loosely about the neck of the person such that the loosely fitting terminal end enables exhaust of air from the chamber to the ambient atmosphere at the terminal end for facilitating the circulation of fresh air through the chamber.

* * * * *